US006035841A

United States Patent [19]

Martin et al.

[11] Patent Number: 6,035,841

[45] Date of Patent: Mar. 14, 2000

[54] ARCHERY BOWS, AND ARCHERY BOW CAM AND WEIGHT SYSTEMS

[75] Inventors: Terry G. Martin, Walla Walla, Wash.; George T. Newbold, Milton-Freewater, Oreg.

[73] Assignee: Martin Archery Inc., Walla Walla, Wash.

[21] Appl. No.: 09/221,491

[22] Filed: Dec. 22, 1998

[51] Int. Cl.[7] ..... F41B 5/10

[52] U.S. Cl. ..... 124/25.6; 124/900

[58] Field of Search ..... 124/23.1, 25.6, 124/900

[56] References Cited

U.S. PATENT DOCUMENTS

| | | | |
|---|---|---|---|
| D. 331,614 | 12/1992 | Martin et al. | D22/107 |
| 4,401,097 | 8/1983 | Simonds et al. | 124/25.6 |
| 4,438,753 | 3/1984 | Simonds | 124/25.6 |
| 4,478,203 | 10/1984 | Hayes | 124/25.6 |
| 4,512,326 | 4/1985 | Jarrett | 124/25.6 |
| 4,993,399 | 2/1991 | Chattin | 124/25.6 |
| 5,031,599 | 7/1991 | Cruise | 124/23.1 |
| 5,174,268 | 12/1992 | Martin et al. | 124/25.6 |
| 5,809,982 | 9/1998 | McPherson | 124/25.6 |

OTHER PUBLICATIONS

Instruction Manual, "Martin Cheetah DynaBo"; Martin Archery Inc., prior to 1980, Color Press, College Place, Washington.

Kam–Act "MK–2" Instruction Manual Excerpt, earl 1970's.

Kam–Act Instruction Excerpt for Martin Archery Inc., "New for '74", mid–1970's.

Advertising from Mathews Solocam, Z–Max, Feb. 1998.

*Primary Examiner*—John A. Ricci

*Attorney, Agent, or Firm*—Wells, St. John, Roberts, Gregory & Matkin P.S.

[57] ABSTRACT

In one aspect, the invention includes an archery bow construction comprising: a) a rotating member rotatably joined to a first limb; and b) a weight removably attached to the rotating member, the weight comprising at least two discrete components, the discrete components being fastened together by a pin extending into the discrete components. In another aspect, the invention includes an archery bow construction comprising: a) a cam rotatably joined to a first limb and comprising a screw thread; and b) a weight removably attached to the cam, the weight comprising a screw thread complementary to that of the cam and comprising a mass of at least 100 grains. In yet another aspect, the invention includes an archery bow construction comprising: a) a cam having a first orifice, a ridge within the first orifice, and a second orifice proximate the first orifice; b) a weight removably attached to the cam and being within the first orifice and on the ridge; and c) a first pin within the second orifice of the cam and comprising a portion which overlaps the weight and retains the weight within the first orifice. In yet another aspect, the invention includes an archery bow construction comprising a cam rotatably joined to a first limb, the cam comprising: a) an orifice extending therein; b) at least one rod extending across the orifice; and c) a weight engaged on the rod.

29 Claims, 6 Drawing Sheets

ARCHERY BOWS, AND ARCHERY BOW CAM AND WEIGHT SYSTEMS

TECHNICAL FIELD

The invention pertains to archery bows, and particularly pertains to archery bows utilizing a cam system.

BACKGROUND OF THE INVENTION

A popular design for archery bows is to incorporate one or more cams (for example, eccentric wheels) into the bow. Such cams enable peak draw weight to be reached in the middle of a draw such that draw weight drops at full draw. A general goal of archery bow design is to alleviate vibrations from occurring as an arrow is released from the bow. Vibrations can decrease the accuracy with which the arrow is released. Also, vibrations can cause noise in hunting situations that will startle game and lead to lost second shot opportunities.

Another general goal of archery bow designs is to increase a speed with which an arrow is projected by a bow. Arrows which fly faster can maintain a flatter trajectory over a greater distance than slower-traveling arrows. This can enable faster-flying arrows to be fired more accurately than slower-traveling arrows.

In light of the above-discussed goals, it would be desirable to develop archery bow components which can reduce bow vibration and/or increase arrow speed.

SUMMARY OF THE INVENTION

In one aspect, the invention comprises an archery bow construction. The archery bow construction has a first limb and a second limb, and a handle between the limbs. The archery bow construction also has a rotating member rotatably joined to the first limb, and a string extending between the rotating member and the second limb. Additionally, the archery bow construction has a weight removably attached to the rotating member. The weight comprises at least two discrete components, and the discrete components are fastened together by a pin extending into the discrete components.

In another aspect, the invention includes an archery bow construction having a cam rotatably joined to a first limb and comprising a screw thread. The archery bow construction also includes a weight removably attached to the cam. The weight comprises a screw thread complementary to that of the cam and has a mass of at least 100 grains. The screw thread of the weight is threadedly engaged with the screw thread of the cam.

In yet another aspect, the invention includes an archery bow construction a cam having a first orifice and a ridge within the first orifice. The cam further comprises a second orifice proximate the first orifice. A weight is removably attached to the cam and is within the first orifice and on the ridge. A pin is within the second orifice of the cam and comprises a portion which overlaps the weight and retains the weight within the first orifice.

In yet another aspect, the invention includes an archery bow construction having a cam rotatably joined to a first limb and an orifice within the cam. The archery bow construction further includes at least one rod extending across the orifice and a weight engaged on the rod.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
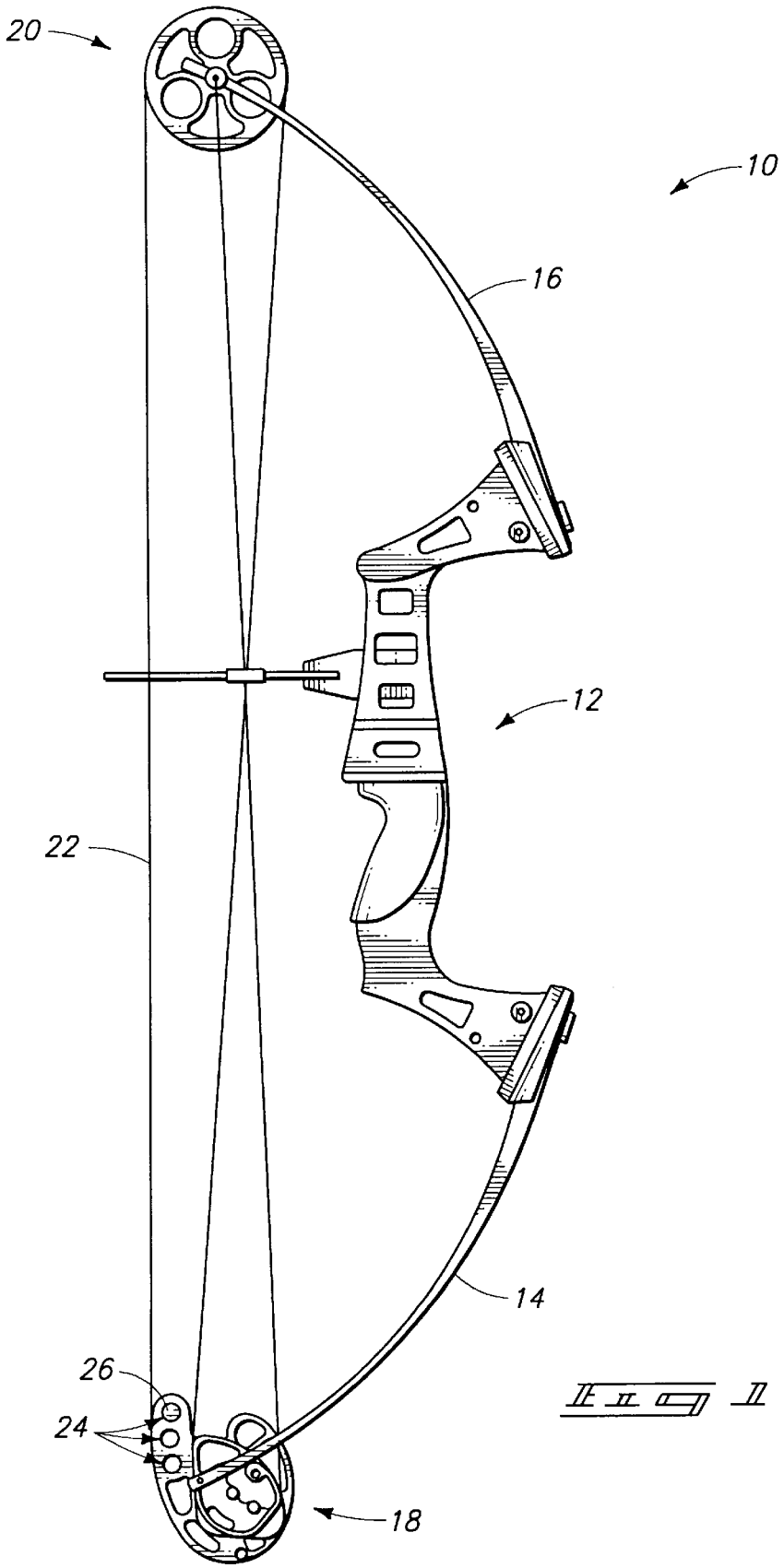
FIG. 1 is a diagrammatic side-view of a first embodiment archery bow construction of the present invention.

FIG. 1 shows a first embodiment archery bow 10 of the present invention. Archery bow 10 comprises a handle 12, and a pair limbs 14 and 16 attached to handle 12. Bow 10 further comprises a cam 18 rotatably attached to limb 14, and an idler wheel 20 rotatably attached to limb 16. A string 22 extends between first and second limbs 14 and 16, and specifically extends between cam 18 and idler wheel 20. Although in the shown embodiment each of limbs 14 and 16 is connected to a rotating member (cam 18 and idler wheel 20, respectively), it is to be understood that the invention encompasses other embodiments (not shown) wherein string 22 is attached either directly to limb 16, or to limb 16 through a non-rotating member.

Cam 18 comprises a plurality of orifices 24 at its outer periphery. Orifices 24 are configured for insertion and removal of a removable weight 26. In the shown embodiment, cam 18 comprises three orifices 24, and a single removable weight 26. Weight 26 can comprise, for example, a metal or a dense organic polymer, and preferably has a mass of from about 100 grains to about 600 grains, and most preferably has a mass of about 400 grains.

In operation, an arrow is nocked onto bow string 22. Bow string 22 is then drawn to rotate cam 18 and exert force on limbs 14 and 16. Subsequently, bow string 22 is released and the force from limbs 14 and 16 propels the arrow from the bow. The weight 26 provided at an outer periphery of cam 18 provides mass at such periphery as the cam rotates during release of an arrow. Such mass can reduce vibration of cam 18, as well as provide additional rotation speed of cam 18. The additional rotation speed can translate into faster arrow speeds relative to the arrow speeds achieved without utilization of weight 26.

The removability of weight 26, together with the utilization of a plurality of orifices 24, enables the mass at the periphery of cam 18 to be adjusted for individual archer's desires. Specifically, a weight 26 provided further outward from a center-of-mass of cam 18 can have more influence on cam 18 than does a weight 26 provided closer to the center-of-mass of cam 18. Additional adjustability can be obtained by providing a set of weights in which the individual weights have different masses. The optimum location and mass of weight 26 can vary substantially between archers. If weight 26 is too light, or placed too close to a center of mass of cam 18, the weight has no measurable effect on either vibration or arrow speed. On the other hand, if weight 26 is too heavy, or placed too far from a center-of-mass of cam 18, the weight is found to slow arrow speed rather than increase it.

The provision of a plurality of orifices 24 cannot only enable a single weight to be placed in alternate locations relative to a center-of-mass of cam 18, but can also enable multiple weights to be placed in a single cam. The multiple weights can have identical masses as one another, or different masses. Preferably, the weights will all have masses of from about 100 grains to about 600 grains.

Figure 2:
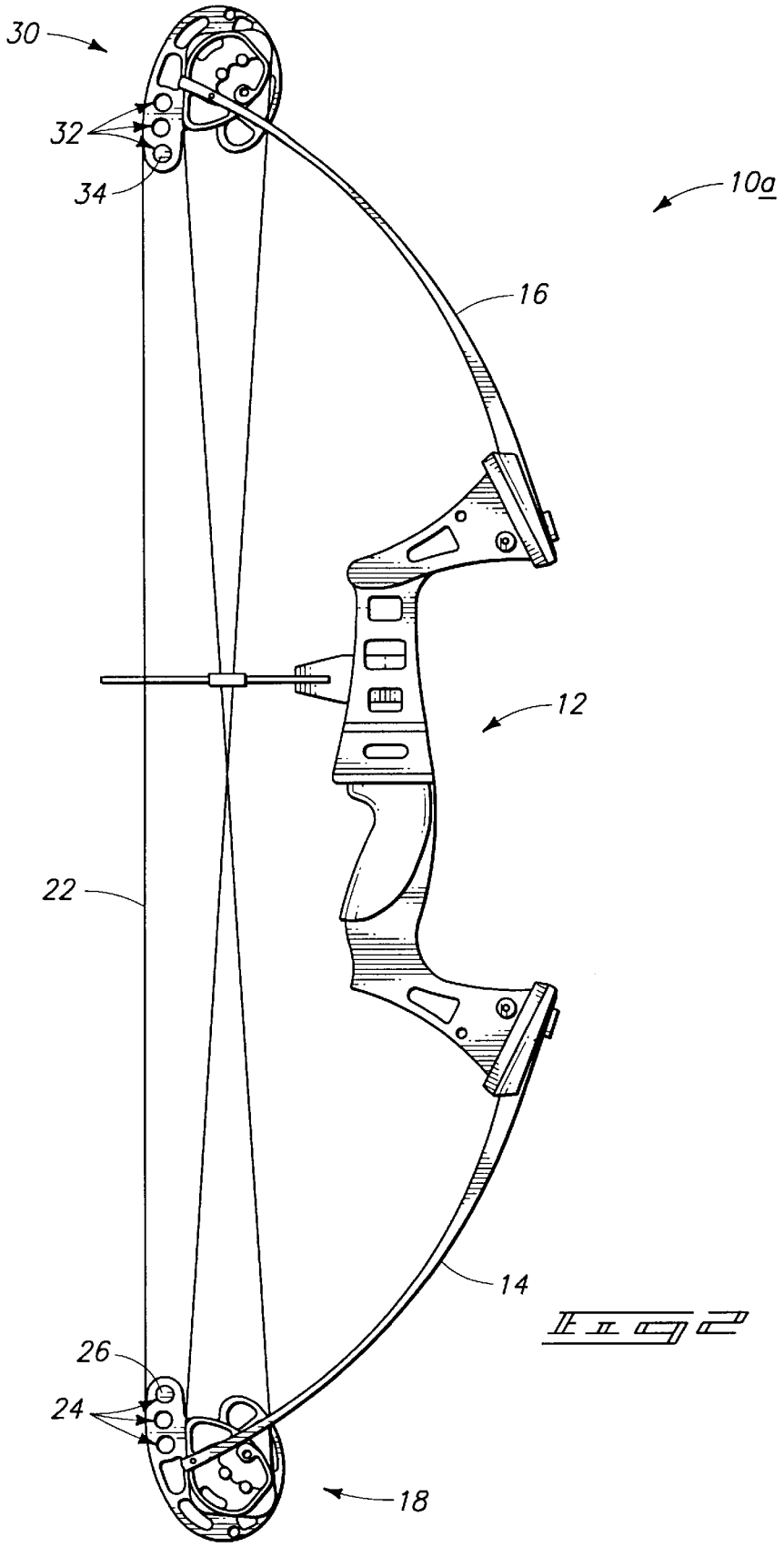
FIG. 2 is a diagrammatic side-view of a second embodiment archery bow construction of the present invention.

A second embodiment archery bow 10*a* is illustrated in FIG. 2. In referring to the embodiment of FIG. 2, similar numbering to that utilized in describing the first embodiment archery bow of FIG. 1 will be used, with differences indicated by the suffix "a" or by different numerals. Archery bow 10*a*, like archery bow 10 of FIG. 1, comprises a handle 12 between a pair of limbs 14 and 16. Bow 10*a* further comprises a string 22 extending between limbs 14 and 16. Archery bow 10*a* differs from the first embodiment archery bow 10 of FIG. 1 in that archery bow 10*a* comprises a first cam 18 and a second cam 30, rather than the cam and idler wheel combination of archery bow 10. In the shown embodiment, cam 30 is identical to cam 18 and comprises orifices 32 and a removable weight 34 within one of the orifices 32. It is to be understood, however, that in alternative embodiments (not shown) a removable weight and orifice system could be provided in only one of cams 18 and 30.

Figure 3:
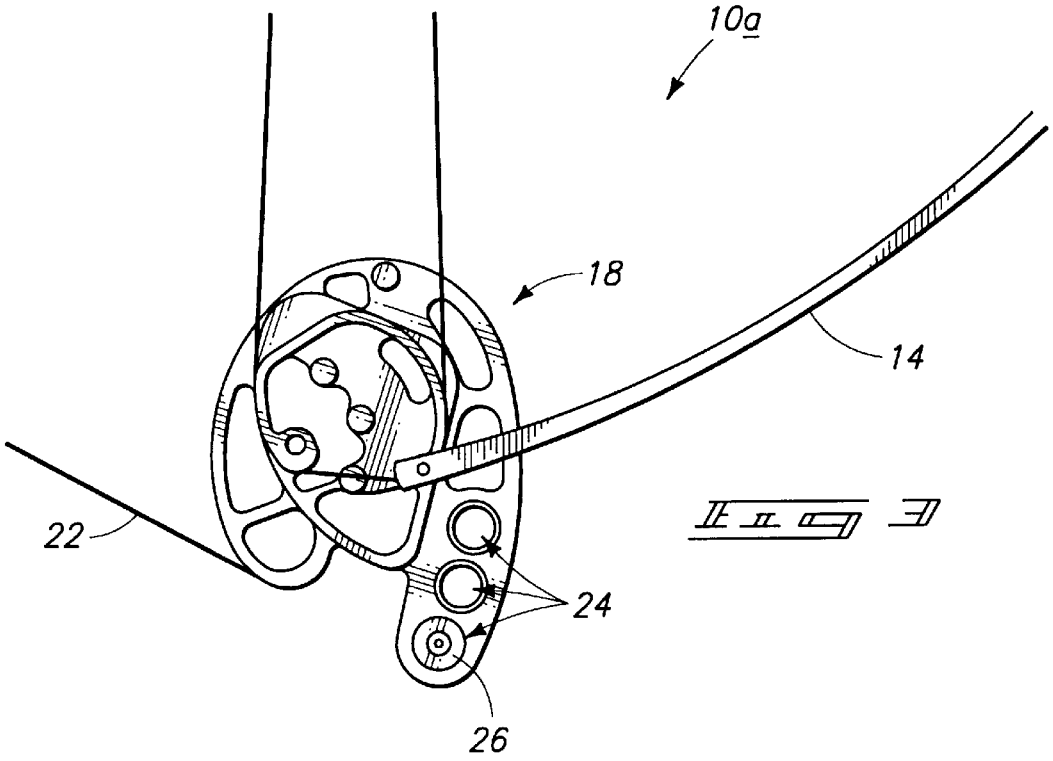
FIG. 3 is an expanded, fragmentary view of a cam constructed in accordance with the present invention, and shown at full-draw of an archery bow.

Operation of cam 18, with removable weight 26 therein, is described with reference to FIGS. 3–6. Referring to FIG. 3, archery bow 10*a* is illustrated with string 22 in a fully-drawn position. Cam 18 is rotated such that weight 26 is outward of limb 14 (the term "outward" being used to contrast relative to the resting position of cam 18 shown in FIG. 2 wherein weight 26 is "inward" of limb 14, i.e., between limbs 14 and 16).

Figure 4:
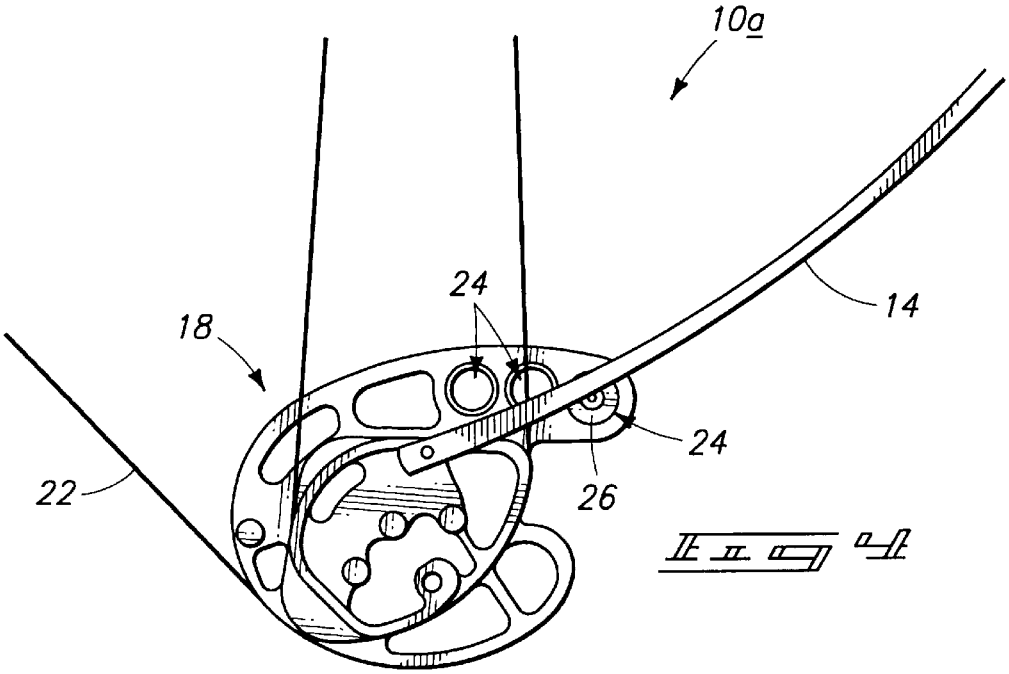
FIG. 4 is a view of the FIG. 3 cam shown at a position partially relaxed from full-draw.
Figure 5:
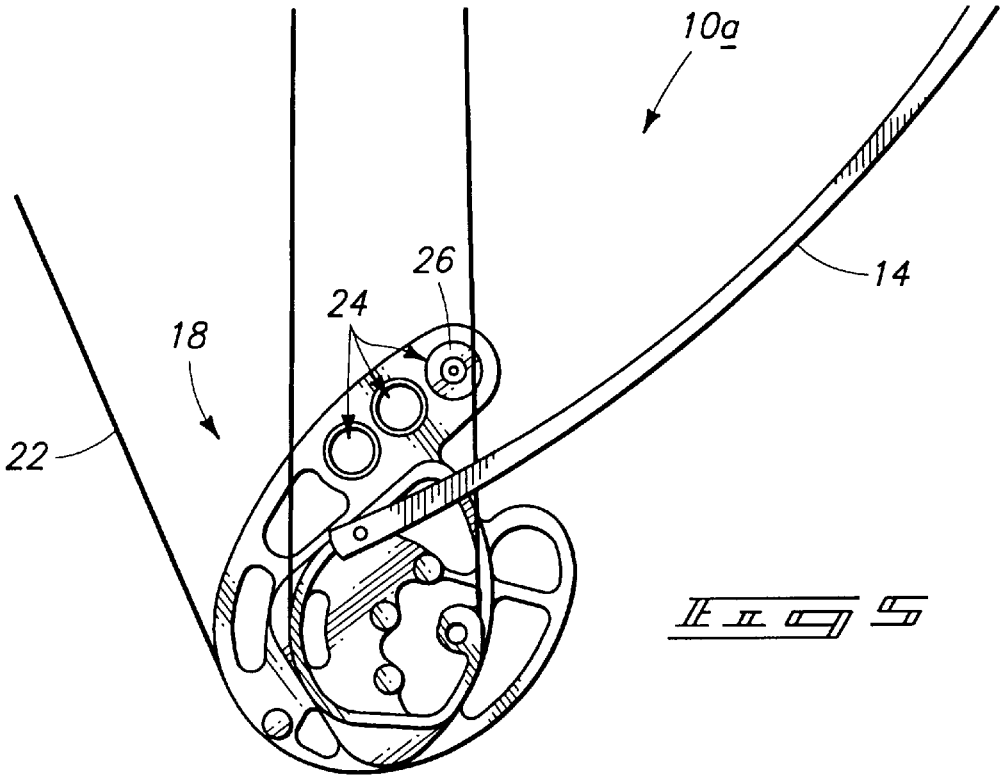
FIG. 5 is a view of the FIG. 3 cam shown at a position further relaxed from full-draw than the position of FIG. 4.
Figure 6:
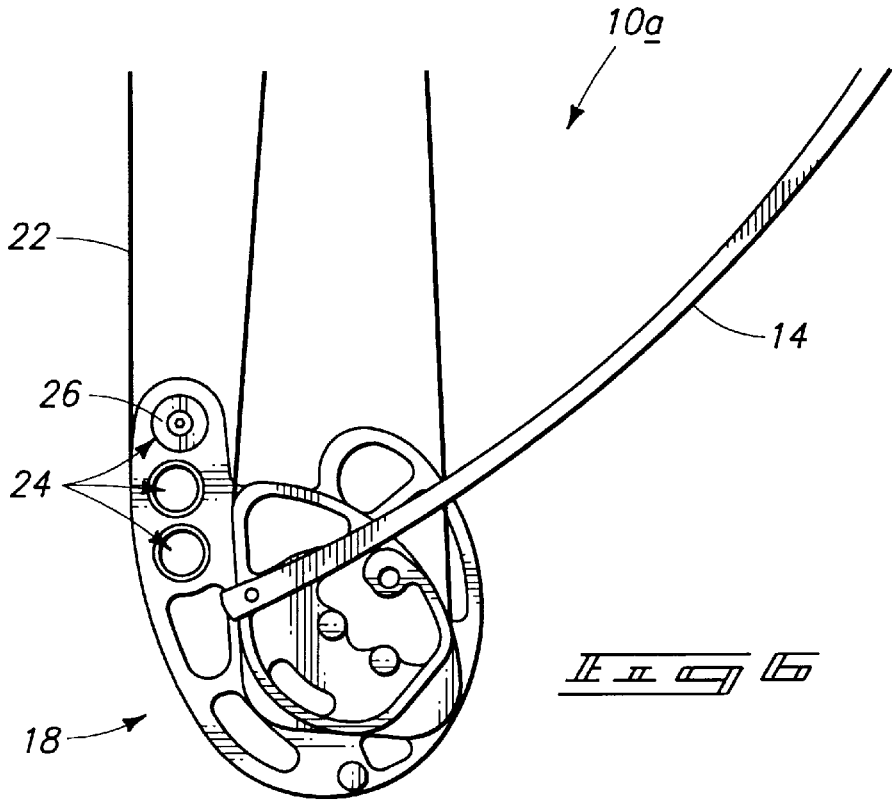
FIG. 6 is a view of the FIG. 3 cam shown at a position fully relaxed from full-draw.

Referring to FIG. 4, cam 18 is illustrated after bow string 22 is partially released from the full-draw position of FIG. 3. Weight 26 has now rotated about an outer periphery of cam 18. The rotation of weight 26 about such outer periphery continues as bow string 22 is further released to the position shown in FIG. 5, and until bow string 22 reaches the resting position of FIG. 6.

Specific embodiments of cam 18 and weight 26 are described with reference to FIGS. 7–9.

Figure 7:
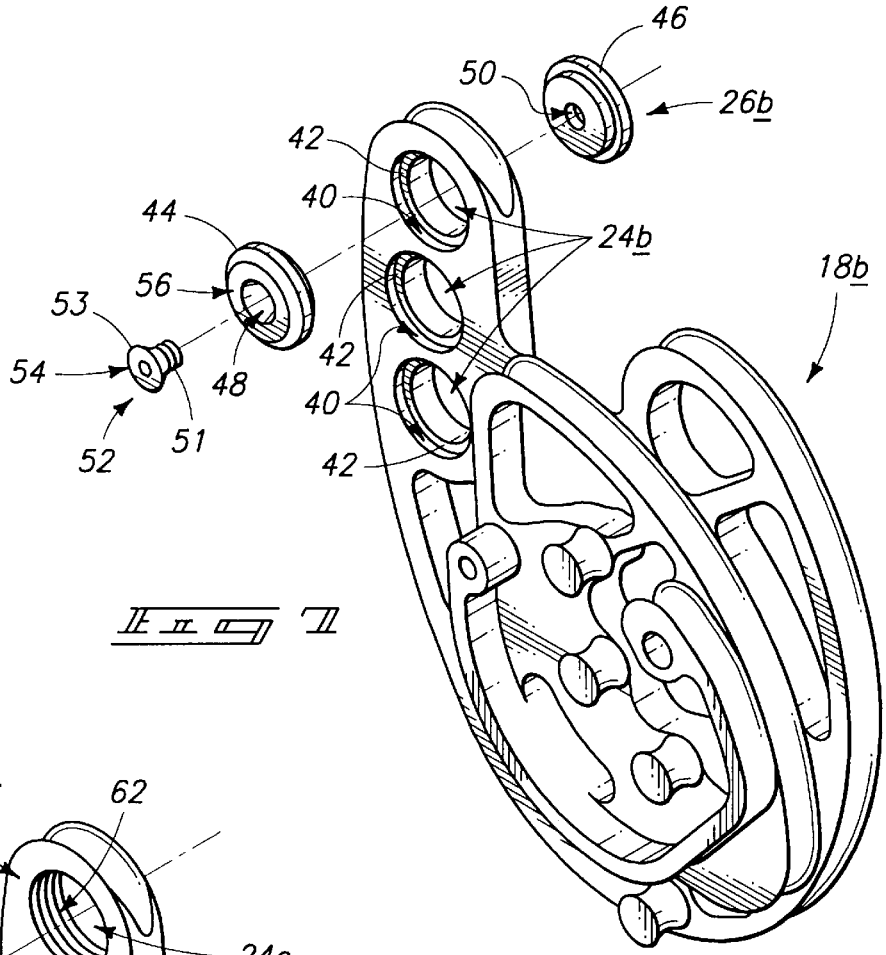
FIG. 7 is an exploded view of an archery bow cam in accordance with an embodiment of the present invention.

Referring first to the embodiment of FIG. 7, a cam 18*b* and removable weight 26*b* are shown in an exploded view. In referring to FIG. 7, similar numbering to that utilized above in describing FIGS. 1–6 will be used, with differences indicated by the suffix "b" or by different numerals.

Cam 18*b* can be formed from, for example, an aluminum alloy. Cam 18*b* comprises three orifices 24*b*. Each of the orifices has a circular-shape and comprises a periphery 40. Cam 18*b* further comprises circular ridges 42 within orifices 24*b* and extending around peripheries 40.

Weight 26*b* comprises a pair of discrete disc-shaped components 44 and 46, each of which comprises a circular outer periphery configured to be retained within a periphery 40 of an orifice 24*b*. Discrete components 44 and 46 can be formed from, for example, brass or other metals, and can have approximately the same weight as one another.

Components 44 and 46 comprise openings 48 and 50, respectively. Component 46 further comprises a screw thread (now shown) within opening 50. A screw 52 is provided to extend through opening 48 of component 44 and engage the screw thread of component 46. More specifically, screw 52 comprises a threaded extension 51 which engages the screw thread of component 46. Screw 52 also comprises a head 53 having a planar outer surface 54. In the shown preferred embodiment, component 44 comprises a recessed outer portion of opening 48 configured to receive head 53 of screw 52. Component 44 further comprises a planar outer surface 56 proximate the received head 53. Head 53 of screw 52 is preferably received within opening 48 such that outer surface 54 of head 53 is substantially flush with outer surface 56 of component 44.

It is noted that opening 48 of component 44 can be threaded to engage threaded portion 51 of screw 52, or can be slightly wider than threaded portion 51 so that screw 52 slides through component 44 to engage threaded opening 50 of component 46.

In the shown embodiment, components 44 and 46 are configured to receive ridge 42 between them as the components are fastened to cam 18*b*.

Figure 8:
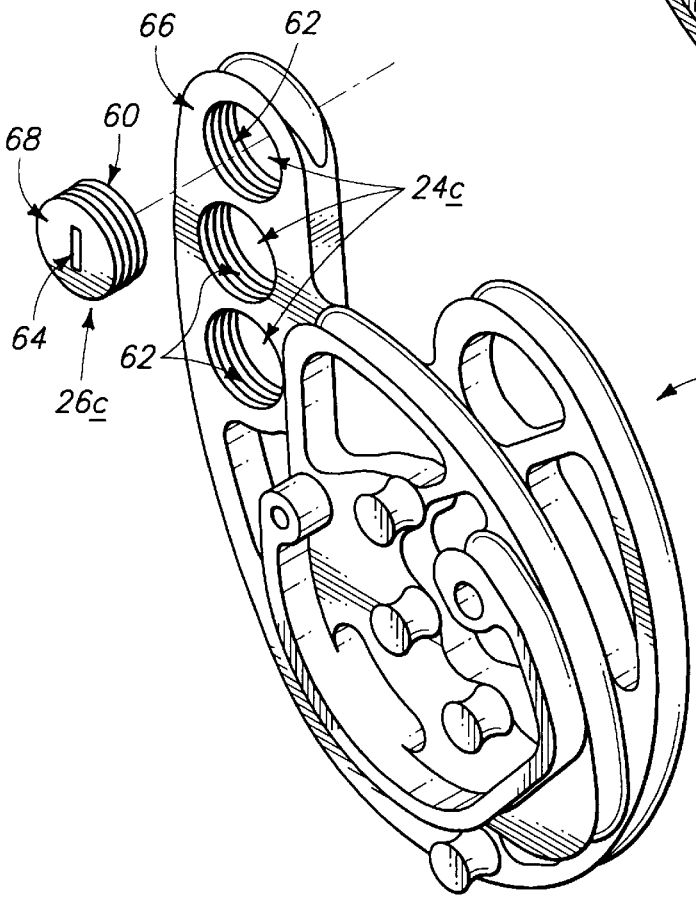
FIG. 8 is an exploded view of an archery bow cam in accordance with another embodiment of the present invention.
Figure 9:
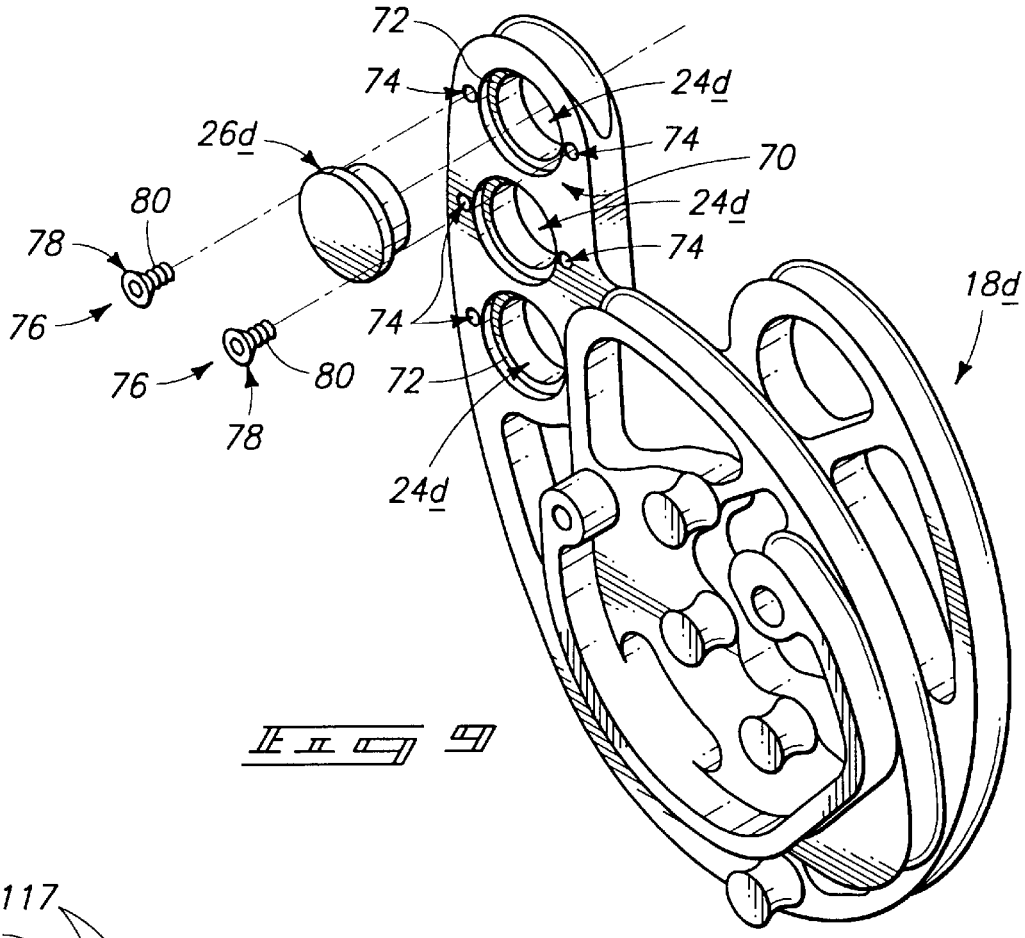
FIG. 9 is an exploded view of an archery bow cam in accordance with yet another embodiment of the present invention.

Another embodiment cam and weight system of the present invention is illustrated in FIG. 8, with the cam being referred to as 18*c* and the weight labeled as 26*c*. In referring to FIG. 8, similar numbering to that utilized above in describing FIGS. 1–6 will be used, with differences indicated by the suffix "c" or by different numerals.

Cam 18*c* comprises a plurality of orifices 24*c*, and comprises screw threads 62 within each of orifices 24*c*. Weight 26*c* is effectively a screw and comprises screw threads 60 around its outer periphery. Screw threads 60 are configured to be received within screw threads 62 to secure weight 26*c* within an orifice 24*c*. Weight 26*c* further comprises a slot 64 configured to receive a tool to simplify rotation of weight 26*c* within orifices 24*c*. Slot 64 can be sized to accommodate a screwdriver, and more preferably is sized to accommodate a coin.

Cam 18*c* comprises opposing planar front and back side surfaces, with planar front side surface 66 being visible in FIG. 8 and the planar back side surface not being visible in the FIG. 8 view. Weight 26*c* comprises opposing planar front and back side surfaces, with planar front side surface 68 being visible in FIG. 8 and the planar back side surface not being visible in the FIG. 8 view. In the shown preferred embodiment, weight 26*c* is configured such that when weight 26*c* is entirely received within cam 18*c*, front side surface 68 is substantially flush with front side surface 66. Further, the back side surface of weight 26*c* is preferably also flush with the back side surface of cam 18*c* when weight 26*c* is fully received within cam 18*c*.

A third embodiment cam and weight system of the present invention is described with reference to FIG. 9, with the cam being labeled as 18*d*, and the weight as 26*d*. In referring to FIG. 9 similar numbering to that utilized above in describing FIGS. 1–6 will be used, with differences indicated by the suffix "d" or by different numerals.

Cam 18*d* comprises orifices 24*d* configured to receive weight 26*d*. Also, cam 18*d* comprises a front side planar outer surface 70 proximate orifices 24*d*, and an opposing planar back side surface (not shown) proximate the back side of orifices 24*d*.

Orifices 24*d* are circular in shape, and cam 18*d* defines a circular periphery of each of orifices 24*d*. Further, cam 18*d* comprises a ridge 72 within each of orifices 24*d*. In the shown embodiment, ridge 72 extends only partially across orifices 24*d*. However, the invention encompasses other embodiments (not shown) wherein ridge 72 extends entirely across orifices 24*d* and effectively defines a bottom of orifices 24*d*.

Cam 18*d* comprises additional orifices 74 proximate the orifices 24*d*. In the shown embodiment, each of orifices 24*d* is associated with a pair of the additional orifices 74. Pins 76 are provided to extend within orifices 74 and retain weight 26*d* within orifices 24*d*. In the shown embodiment, pins 76 are screws comprising screw heads 78 and threaded portions 80. Also, orifices 74 comprise internal threads (not shown) configured to receive threaded portions 80. Weight 26*d* is retained within an orifice 24*d* by the heads 78 of screws 76. Screws 76 can comprise, for example, so-called "button head" screws.

In the shown embodiment, only one weight is retained within any single orifice by screws 76. However, the invention encompasses other embodiments (not shown) wherein a plurality of weights are retained within a single orifice by screws 76. Preferably, all of individual weights of such plurality of weights are disc-shaped. The individual weights can have identical masses as one another, or different masses. The utilization of a plurality of weights can enable the total mass of weights within cam 18*d* to be tailored for individual archer's desires.

Figure 10:
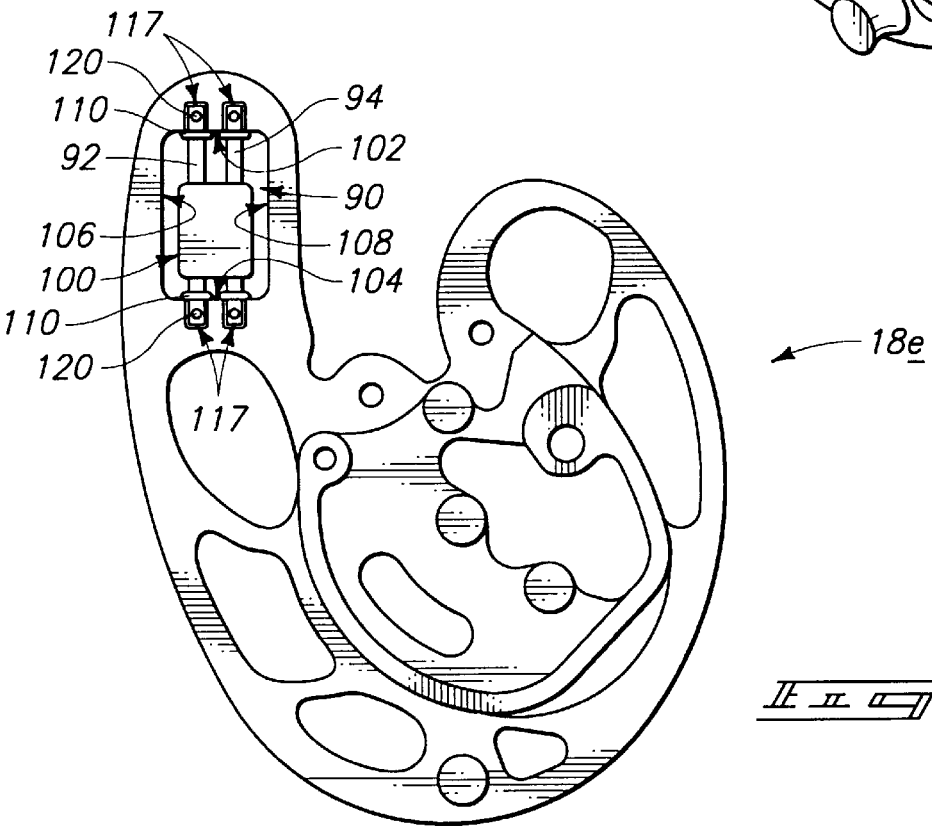
FIG. 10 is a side-view of an archery bow cam constructed in accordance with yet another embodiment of the present invention.

Yet another embodiment of the invention is described with reference to FIG. 10, wherein a cam is labeled 18*e*. In referring to FIG. 10, similar numbering to that utilized above in describing FIGS. 1–6 will be used, with differences indicated by the suffix "e" or by different numerals.

Cam 18*e* comprises an orifice 90. A pair of rods 92 and 94 extend across orifice 90. Rods 92 and 94 preferably comprise rigid materials, such as, for example, metallic bars. A weight 100 is slidably engaged on rods 92 and 94. Weight 100 is configured such that as cam 18*e* rotates, the weight slides along rods 92 an 94 and across orifice 90. In the shown embodiment, orifice 90 extends entirely through a thickness of cam 18*e*. However, it is to be understood that the invention encompasses other embodiments (not shown) wherein orifice 90 extends only partially through the thickness of cam 18*e*.

In the shown embodiment, cavity 90 comprises a rectangular shape having a pair of opposing endwall peripheries 102 and 104, as well as a pair of opposing sidewall peripheries 106 and 108. Rods 92 and 94 extend from endwall periphery 102 to endwall periphery 104. Cushions 110 are provided adjacent endwall peripheries 102 and 104 to cushion weight 100 as it reaches the ends of its travel along rods 92 and 94. Cushions 110 can be, for example, O-rings, and preferably comprise relatively flexible materials, such as, for example, rubber, foam or plastic. Weight 100 preferably comprises a relatively dense material, such as, for example, a metal, polyurethane, or dense foam.

In the shown preferred embodiment, rods 92 and 94 extend into cavities 117 of cam 18*e* and are retained by pins 120. Pins 120 can comprise, for example, screws. Utilization of screws enables rods 92 and 94 to be removable such that weight 100 can be replaced with a weight of a different mass to allow adjustment for individual archer needs. Weight 100 preferably comprises a mass of from about 100 grains to about 600 grains. In an exemplary embodiment, weight 100 is about 3/16-inch thick and comprises solid brass.

In the shown and preferred embodiment, weight 100 and rods 92 and 94 are oriented such that weight 100 slides against one of the endwalls (endwall 104) when a bow string is an undrawn position (such as the position shown in FIG. 2), and slides against the other endwall (endwall 102) when the bow string is in a fully drawn position (such as the position of FIG. 3). Weight 100 will then undergo a sliding motion as a bow string is released from a fully-drawn position to an undrawn position, and thereby change the mass characteristics within cam 18*e* as the cam rotates. Specifically, when weight 100 is against endwall 102, it provides additional mass toward a periphery of cam 18*e*. Such additional mass is brought closer to a center-of-mass of cam 18*e* as weight 100 slides from endwall 102 to endwall 104.

In the shown embodiment, a pair of rods 92 and 94 are utilized to retain weight within orifice 90. The utilization of pair of rods prevents weight 100 from rotating within orifice 90. Other embodiments (not shown) of the invention utilize only a single rod for retaining weight 100 within opening 90. In such single-rod-embodiments, the rod can be provided to have a noncircular cross-sectional shape to avoid rotation of mass 100 around the rod. For instance, the rod can be provided to have a square cross-sectional shape, or can be provided to have ridges.

In preferred aspects of the invention, a lubricant can be provided between weight 100 and rods 92 and 94. Such lubricant can comprise, for example, graphite or oil.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An archery bow construction comprising:

a first limb and a second limb;

a handle between the limbs;

a rotating member rotatably joined to the first limb;

a string extending between the rotating member and the second limb; and a weight removably attached to the rotating member, the weight comprising at least two discrete components, the discrete components being fastened together by a pin extending into the discrete components.

2. The archery bow construction of claim 1 further comprising a portion of the rotating member being between the fastened together discrete components.

3. The archery bow construction of claim 1 wherein the pin is a screw.

4. The archery bow construction of claim 1 wherein the rotating member is a cam.

5. An archery bow construction comprising:

a first limb and a second limb;

a handle between the limbs;

a rotating member rotatably joined to the first limb;

a string extending between the rotating member and the second limb, the string being connected through the rotating member to the first limb and being connected to the second limb, the string being connected to the first and second limbs such that drawing on the string rotates the first member and exerts force on the limbs;

a weight removably attached to the rotating member, the weight comprising:

two discrete components;

a screw thread in one of the discrete components;

an opening extending through the other of the discrete components; and the discrete components being fastened together by a threaded member extending through the opening in said other of the discrete components and engaging the screw thread in said one of the discrete components; and a portion of the rotating member being between the fastened together discrete components.

6. The archery bow construction of claim 5 wherein the rotating member is a cam.

7. The archery bow construction of claim 5 further comprising a second rotating member rotatably joined to the second limb, the string extending from the first rotating member to the second rotating member.

8. The archery bow construction of claim 7 wherein the second rotating member comprises a second removable weight.

9. The archery bow construction of claim 5 wherein the rotating member is a cam and further comprising a second cam rotatably joined to the second limb, the string extending from the first cam to the second cam.

10. The archery bow construction of claim 9 wherein the second cam comprises a second removable weight.

11. The archery bow construction of claim 5 wherein:

the threaded member is a screw having a head;

the other of the discrete components comprises a substantially planar outer surface proximate the opening and a recess extending into the substantially planar surface; and the head of the screw is received within the recess, the head of the screw having an outermost surface, the outermost surface of the head of the screw not extending outwardly beyond the outer surface of the substantially planar surface.

12. The archery bow construction of claim 11 wherein:

the discrete components are disc-shaped and fastened together to form a disc-shaped weight having a circular periphery;

the rotating member comprises a circular orifice and a circular ridge around a periphery of the orifice;

the weight is received within the orifice; and the circular ridge is the portion of the rotating member between the fastened together discrete components.

13. An archery bow construction comprising:

a first limb and a second limb;

a handle between the limbs;

a cam rotatably joined to the first limb, the cam comprising a screw thread;

a string extending between the cam and the second limb;

a weight removably attached to the cam, the weight comprising a screw thread complementary to that of the cam and comprising a mass of at least 100 grains; and the screw thread of the weight being threadedly engaged with the screw thread of the cam.

14. The archery bow construction of claim 13 wherein the weight has a mass of from about 100 grains to about 600 grains.

15. An archery bow construction comprising:

a first limb and a second limb;

a handle between the limbs;

a cam rotatable joined to the first limb, the cam comprising a circular orifice and a screw thread around a periphery of the orifice;

a string extending between the cam and the second limb;

a weight removably attached to the cam, the weight being a disc having a circular periphery and a screw thread around said periphery;

the weight being threadedly received within the orifice of the cam; and wherein:

the cam comprises opposing substantially planar outer surfaces;

the weight comprises opposing substantially planar outer surfaces; and the substantially planar outer surfaces of the weight are about flush with the substantially planar outer surfaces of the cam.

16. An archery bow construction comprising:

a first limb and a second limb;

a handle between the limbs;

a cam rotatably joined to the first limb, the cam comprising:

a first orifice;

a ridge within the first orifice; and a second orifice proximate the first orifice;

a string extending between the cam and the second limb;

a weight removably attached to the cam, the weight being within the first orifice and on the ridge; and a first pin within the second orifice of the cam and comprising a portion which overlaps the weight and retains the weight within the first orifice.

17. The archery bow construction of claim 16 further comprising:

a third orifice proximate the first orifice;

a second pin within the third orifice; and the second pin comprising a portion which overlaps the weight and retains the weight within the first orifice.

18. The archery bow construction of claim 17 wherein the first and second pins are screws and wherein the portions overlapping the weight are screw heads.

19. An archery bow cam and weight system, comprising:

an archery bow cam; and a weight removably attachable to the cam, the weight comprising at least two discrete components fastened together by a pin extending into the discrete components.

20. The archery bow cam and weight system of claim 19 further comprising a portion of the cam between the fastened together discrete components.

21. The archery bow cam and weight system of claim 19 wherein the pin is a screw.

22. The archery bow cam and weight system of claim 19 wherein each of the discrete components has approximately the same weight as the other of the discrete components.

23. An archery bow cam and weight system, comprising:

an archery bow cam; and a weight removably attachable to the cam, the weight comprising:

two discrete components;

a screw thread in one of the discrete components;

an opening extending through the other of the discrete components;

the discrete components being fastened together by a threaded member extending through the opening in said other of the discrete components and engaging the screw thread in said one of the discrete components; and a portion of the cam being between the fastened together discrete components.

24. The archery bow cam and weight system of claim 23 wherein:

the threaded member is a screw having a head;

the other of the discrete components comprises a substantially planar outer surface proximate the opening and a recess extending into the substantially planar surface; and the head of the screw is received within the recess, the head of the screw having an outermost surface, the outermost surface of the head of the screw not extending outwardly beyond the outer surface of the substantially planar surface.

25. The archery bow cam and weight system of claim 24 wherein:

the discrete components are disc-shaped and fastened together to form disc-shaped weight having a circular periphery;

the cam comprises a circular orifice and a circular ridge around a periphery of the orifice;

the weight is received within the orifice; and the circular ridge is the portion of the cam between the fastened together discrete components.

26. An archery bow cam and weight system, comprising:

a cam comprising a circular orifice and a screw thread around a periphery of the orifice; and a weight removably attached to the cam the weight being a disc having a circular periphery and a screw thread around said periphery;

the weight being threadedly received within the orifice of the cam; and wherein:

the cam comprises opposing substantially planar outer surfaces;

the weight comprises opposing substantially planar outer surfaces; and the substantially planar outer surfaces of the weight are about flush with the substantially planar outer surfaces of the cam.

27. An archery bow cam and weight system comprising:

a cam comprising:

a first orifice;

a ridge defining a bottom of the first orifice; and a second orifice proximate the first orifice;

a weight removably attached to the cam, the weight being within the first orifice and on the ridge; and a first pin within the second orifice of the cam and comprising a portion which overlaps the weight and retains the weight within the first orifice.

28. The archery bow cam and weight system of claim 27 further comprising:

a third orifice proximate the first orifice;

a second pin within the third orifice; and the second pin comprising a portion which overlaps the weight and retains the weight within the first orifice.

29. The archery bow of claim 28 wherein the first and second pins are screws and wherein the portions overlapping the weight are screw heads.

* * * * *